US005485255A

United States Patent [19]

Reuschle et al.

[11] Patent Number: 5,485,255

[45] Date of Patent: Jan. 16, 1996

[54] AUTOMATIC CLEANING MECHANISM FOR A CORONA CHARGER USING CLEANING PAD

[75] Inventors: Patricia D. Reuschle, Hilton; Michael Kenin, Rochester; John E. Posato, Spencerport; Joseph M. Szostek, Rochester, all of N.Y.

[73] Assignee: Eastman Kodak Company, Rochester, N.Y.

[21] Appl. No.: 298,875

[22] Filed: Aug. 31, 1994

[51] Int. Cl.[6] ..... G03G 15/02

[52] U.S. Cl. ..... 355/225; 250/325; 355/215

[58] Field of Search ..... 355/215, 219, 355/221, 225; 250/324, 325; 361/229, 230

[56] References Cited

U.S. PATENT DOCUMENTS

| | | | |
|---|---|---|---|
| 3,870,883 | 3/1975 | Oagley | 250/324 |
| 3,875,407 | 4/1975 | Hayne | 355/215 |
| 4,038,546 | 7/1977 | Jasinski | 355/215 |
| 4,680,669 | 7/1987 | Tuchiya et al. | 355/215 |
| 4,788,573 | 11/1988 | Nakaoka et al. | 355/215 |
| 4,811,050 | 3/1989 | Tanjo et al. | 355/221 |
| 4,864,363 | 9/1989 | Shinada | 355/133 |
| 4,885,466 | 12/1989 | Koichi et al. | 250/324 |
| 4,924,268 | 5/1990 | Ogura | 355/219 |
| 4,956,671 | 9/1990 | Otsuka | 355/215 |
| 5,012,093 | 4/1991 | Shimizu | 250/324 |
| 5,089,848 | 2/1992 | Kusuda et al. | 355/206 |
| 5,089,850 | 2/1992 | Ogura et al. | 355/215 |
| 5,182,694 | 1/1993 | Endo | 361/229 |
| 5,194,897 | 3/1993 | Yoshiyama et al. | 355/215 |

FOREIGN PATENT DOCUMENTS

| | | |
|---|---|---|
| 61-117579 | 6/1986 | Japan . |
| 61-124969 | 6/1986 | Japan . |
| 2-105179 | 4/1990 | Japan . |
| 4-000463 | 1/1992 | Japan . |
| 4-146463 | 5/1992 | Japan . |

*Primary Examiner*—Robert Beatty
*Attorney, Agent, or Firm*—Lawrence P. Kessler

[57] ABSTRACT

A mechanism for automatically cleaning the corona wires and charge control grid of a corona charger. The simplified cleaning mechanism comprises a cleaning pad assembly having opposed substantially parallel surfaces for wiping substantially parallel operative surfaces of the corona charger corona wire and grid. The cleaning pad assembly is held within the corona charger in association with the corona wire and grid, and is movable along substantially the length of the corona wire and grid. The cleaning pad assembly is automatically selectively activated such that, on linear movement, the cleaning pad assembly cleans the corona wire and charge control grid at the same time. The cleaning pad includes a cleaner bar, a batting member matching a surface of the cleaner bar and a cleaning material wrapped around the cleaner bar and batting member.

20 Claims, 3 Drawing Sheets

36
3
42
3
68
68a
44
68
68a
66
70
34
32
14
36
12a
16a
72
30
10
78a
12c
16b
18
74
12
12b
86
76
46
78b
40
LOGIC
&
CONTROL
82
84
84a
88
48
80

AUTOMATIC CLEANING MECHANISM FOR A CORONA CHARGER USING CLEANING PAD

BACKGROUND OF THE INVENTION

The present invention relates in general to a corona charger for use in an electrostatographic reproduction apparatus or the like, and more particularly to an automatic cleaning mechanism for the corona wires and grid of a corona charger.

In typical commercial electrostatographic reproduction apparatus (such as copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member, and an electric field applied to transfer the marking particle developed image to the receiver member from the dielectric member. After transfer, the receiver member bearing the transferred image is transported away from the dielectric member and the image is fixed to the receiver member by heat and/or pressure to form a permanent reproduction thereon.

The electrostatic fields for various reproduction apparatus operations are commonly provided by corona charging devices. For example, corona chargers may be used to deposit the uniform charge on the dielectric member prior to forming the latent image charge pattern, to implement transfer of a developed image from the dielectric member to a receiver member, or to neutralize charge on the dielectric member subsequent to developed image transfer to facilitate release of the receiver member or residual marking particles from the dielectric member.

Corona chargers typically include at least one very thin corona wire, located within a housing shell. The corona wire is electrically coupled to a high voltage potential source to generate ions or charging current to charge a surface (such as the dielectric member surface) brought into close proximity with the corona wire. The corona wire is tightly suspended between insulating end blocks, supported in the housing shell, such end blocks being connected to a high voltage source for producing the ion generating condition around the corona wire. A grid may be located between the corona wire and the surface to be charged. The grid is held at a preselected electrical potential to control the specific charge to be laid down on the surface.

It should be well appreciated that the high voltage of the corona wire creates a corrosive environment which adversely affects the wire. That is, the electrically charged atmosphere surrounding the wire is conducive to the promotion of coating and/or pitting of the wire by airborne marking particles, fuser oil mist, or paper dust. Over time, such action on the corona wire will cause the wire, which by its very nature is extremely fragile, to no longer be effective in producing the desired uniform charging of the surface intended to have a charge applied thereto. That is, irregularities in the corona wires will cause charging irregularities which show up as defects in the reproduction being formed. The defects may typically include streaks, spots or mottle. Accordingly, the corona charger, and particularly its grid and corona wires, has to be periodically cleaned to assure proper operation and prolong its useful life.

Examples of corona charger cleaners are shown for example in U.S. Pat. Nos. 3,870,883 (issued Mar. 11, 1975, in the name of Oagley), and, 4,864,363 (issued Sep. 5, 1989, in the name of Shinada). These patents show corona wire cleaners. However, they do not provide for cleaning of the corona charger grid. As such, even though the corona wires are cleaned, the overall effectiveness of the chargers is substantially degraded since the uncleaned grids interfere with the proper corona charger performance. Another example of a corona charger cleaner is found in the Ektaprint EK 85, available from Eastman Kodak Company of Rochester, N.Y. This corona charger cleaner does provide for cleaning of the grid as well as the corona wires. However, the structure is complex, and only provides for cleaning of the surfaces of the corona wires facing in the direction parallel to the surface to be charged. Since the surfaces of the corona wires facing perpendicular to the surface being charged are the primary surfaces from which ions are discharged to the surface being charged, the failure to clean such surfaces represents a severe shortcoming of such cleaner.

SUMMARY OF THE INVENTION

In view of the foregoing discussion, this invention is directed to a simplified mechanism for automatically cleaning the primary operative surfaces of the corona wires and charge control grid of a corona charger at the same time. The cleaning mechanism comprises a cleaning pad assembly having opposed substantially parallel surfaces for wiping substantially parallel operative surfaces of the corona charger corona wire and grid. The cleaning pad assembly is held within the corona charger in association with the corona wire and charge control grid, and is movable along substantially the entire length of the corona wire and grid. The cleaning pad assembly is automatically selectively activated such that, on linear movement, the cleaning pad assembly cleans the corona wire and charge control grid at the same time.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
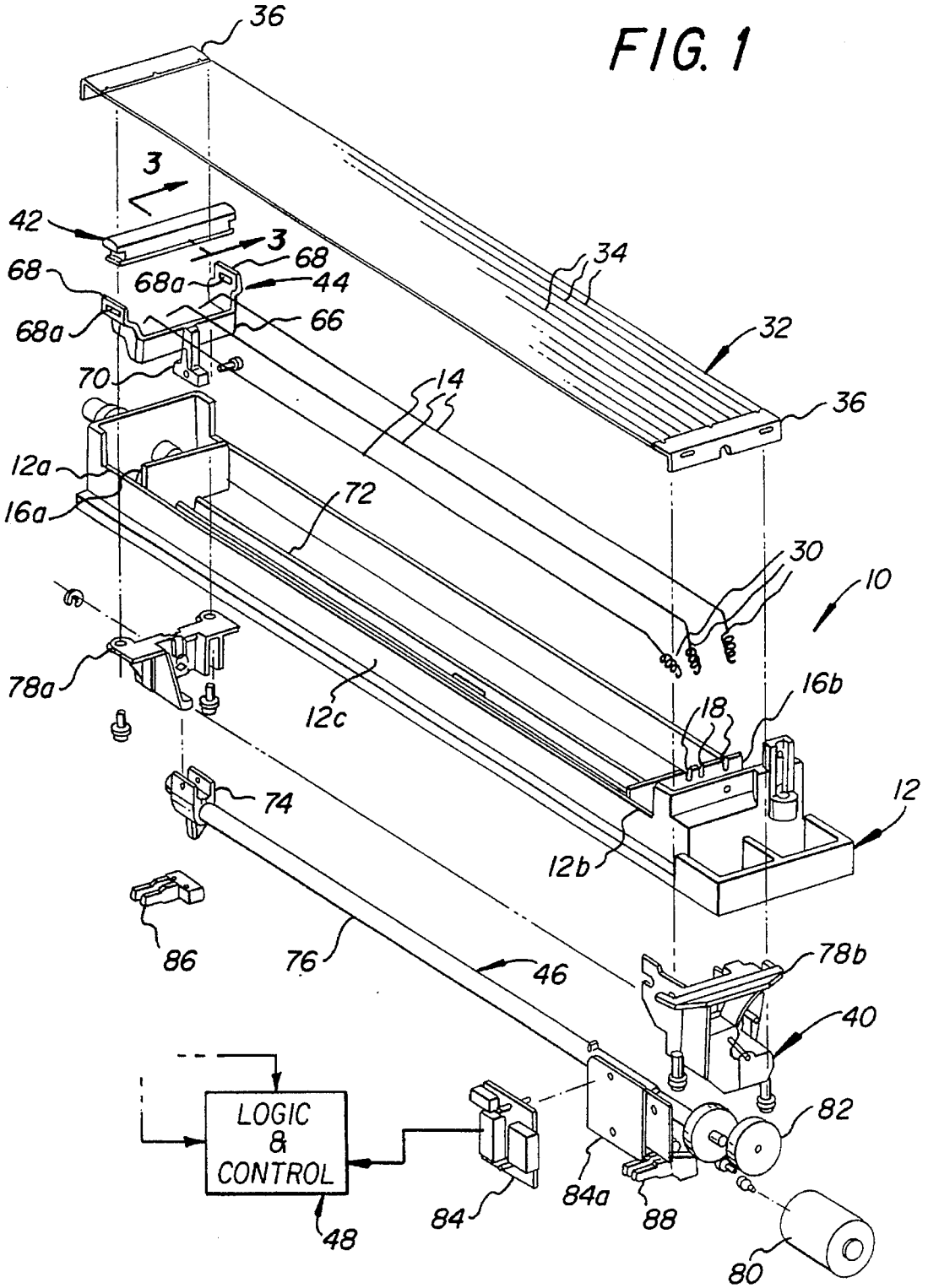
FIG. 1 is an exploded view, in perspective, of a typical corona charger for an electrostatographic reproduction apparatus or the like, and the automatic corona charger cleaning mechanism according to this invention.
Figure 2:
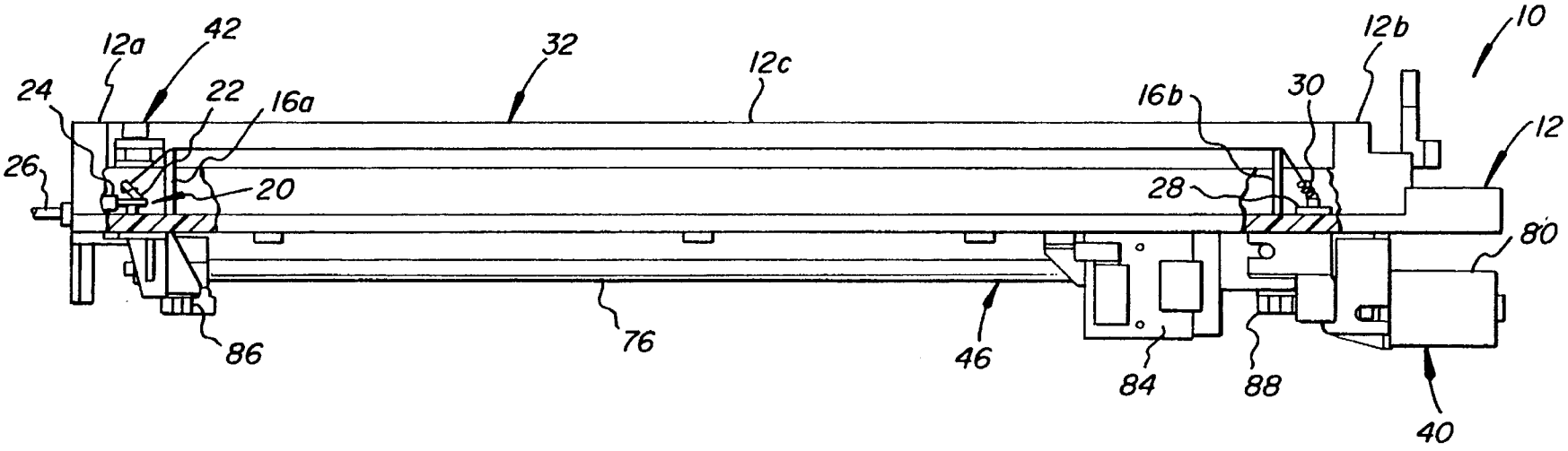
FIG. 2 is a side elevational view of the typical corona charger and automatic corona charger cleaning mechanism of FIG. 1, with portions broken away or in cross-section to facilitate viewing.
Figure 2A:
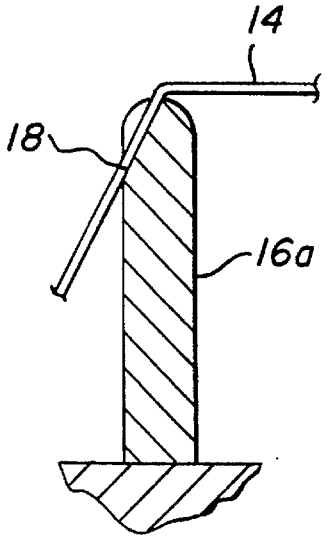
FIG. 2*a* is a side elevational view, on an enlarged scale, of a portion of the typical corona charger and automatic corona charger cleaning mechanism of FIG. 1, with portions broken away or in cross-section to facilitate viewing.
Figure 3:
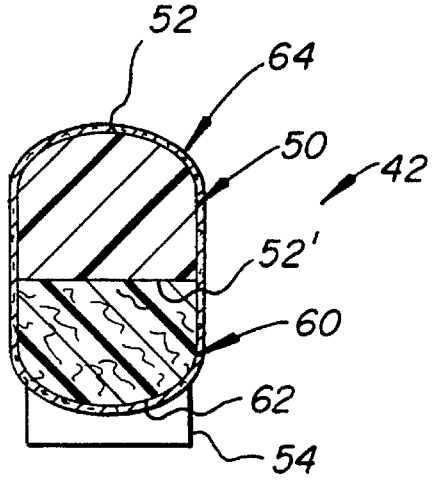
FIG. 3 is a view, in cross-section taken along the lines 3—3 of FIG. 1, of the cleaning pad assembly for the automatic corona charger cleaning mechanism according to this invention.
Figure 4:
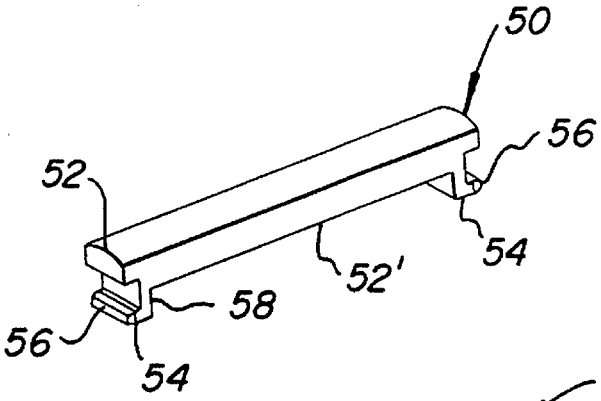
FIG. 4 is a view, in perspective, of the holding member for the cleaning pad assembly of the cleaning mechanism of FIG. 3.
Figure 5:
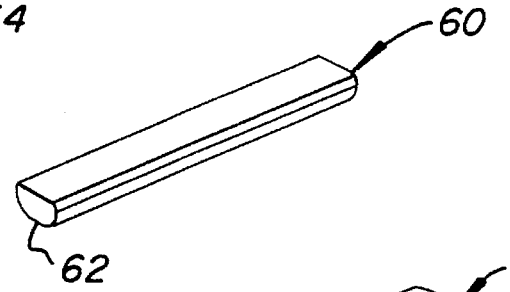
FIG. 5 is a view, in perspective, of a batting member for the cleaning material for the cleaning pad assembly of FIG. 3.
Figure 6:
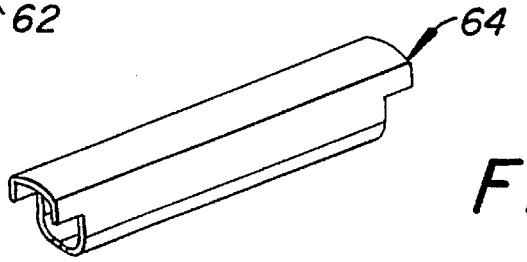
FIG. 6 is a view, in perspective, of the cleaning pad assembly of FIG. 3.

Referring now to the accompanying drawings, FIGS. 1 and 2 show a typical corona charger, designated generally by the numeral 10, for use in an electrostatographic reproduction apparatus such as copier/duplicators, printers, or the like. The corona charger 10 is utilized as discussed above for the general purpose of uniformly charging a surface in such well known electrostatographic reproduction apparatus. The corona charger 10 includes a housing shell 12, of a generally U-shaped cross-section with upstanding legs. The housing shell 12 has a first end portion 12*a* and a second end portion 12*b*, interconnected by an elongated central portion 12*c*, formed for example from an insulative resin material molded in the desired shape as shown. At least one corona wire 14 (three corona wires are shown in the preferred embodiment) is supported to span the length of the central portion 12*c* of the housing shell. The central portion 12*c* is bounded at its ends by walls 16*a* and 16*b*. The walls 16*a*, 16*b* may be integrally formed with the housing shell 12, or may be separate structures connected to the housing shell in any well known manner. The top of the walls 16*a* and 16*b* are rounded, and a plurality of notches 18 are respectively provided in the outboard sides of the walls adjacent to the tops thereof (see, for example, wall 16*a* shown best in FIG. 2*a*). The walls and notches support and locate the corona wires 14, whereby the surface to be charged can be brought into accurate spaced association with the corona wires. The rounding of the top of the walls 16*a* and 16*b* and the location of the notches 18 on the outboard sides thereof have an additional important function which is discussed below.

An anchor assembly 20 (see FIG. 2) is provided in the first end portion 12*a* of the housing shell 12 for anchoring respective ends of the corona wires 14, and for electrically coupling a suitable electrical high voltage potential source to the corona wires. The anchor assembly 20 is formed of conductive material, such as metal for example. The anchor assembly 20 is connected by suitable fasteners to the housing shell 12, and has a plurality of tabs 22 (only one shown in FIG. 2) extending upwardly at an acute angle. The tabs 22 respectively define slots (not shown) at the ends thereof adapted to respectively receive a corona wire 14. The corona wires 14 are, in turn, secured to the tabs 22 by knots (copper lugs for example) or loops formed in the ends of the corona wires.

Additionally, the anchor assembly 20 has a tab 24 connected to an electrical conductor 26 supported so as to extend through an end wall of the housing shell 12. The conductor 26 is adapted to be coupled to a high voltage potential source (not shown), whereby the electrical potential of the source is applied to the corona wires 14 through the electrically conductive path described from the conductor, to the anchor assembly 20, and then to the corona wires.

The respective opposite ends of the corona wires 14 are connected to the housing shell 12, under preselected tension, by an anchor assembly 28 connected by suitable fasteners to the housing shell end portion 12*b*. The anchor assembly 28 has a plurality of members adapted to respectively receive spring elements 30 connected to the ends of the corona wires respectively. Additionally, corona charger has a charge control grid assembly 32 connected to the shell housing 12 so as to span the open area between the walls thereof. The grid assembly 32 includes a plurality of very thin wires 34, running between end supports 36 connected to the end walls of the housing shell 12, substantially parallel to the corona wires 14. The grid assembly 32 may be coupled to an electrical potential source or to ground, in any well known manner, depending upon the desired control of the charge to be laid down by the corona charger 10.

In order to maintain the operating efficiency for the corona charger 10, an automatic cleaning mechanism designated generally by the numeral 40, according to this invention, is provided for cleaning the primary operative surfaces of the corona wires 14 and charge control grid 34 of the corona charger 10. The cleaning mechanism 40 includes a cleaning pad assembly 42 removably mounted on a holding member 44. The holding member 44 is supported for linear movement along the longitudinal axis of the corona charger by a drive mechanism 46. The drive mechanism 46 is operatively associated with a control unit 48 for selectively activating the drive mechanism at desired predetermined intervals to accomplish the cleaning function.

The cleaning pad assembly 42 (as best shown in FIGS. 3–6) includes a cleaner bar 50 formed, for example, of plastic material. The cleaner bar 50 (see FIG. 4) has a main body defining a radiused upper surface 52 and a pair of legs 54 depending from the main body adjacent to the ends thereof. The legs 54 have tabs 56 respectively extending therefrom. As will be further explained below, the tabs 56 are adapted to be removably received by the holding member 44. The surface 52' of the main body (opposite the surface 52) and the legs 54 define a receptacle 58 for receiving a batting member 60 (see FIG. 5) in juxtaposition with the cleaner bar. The batting 60 is formed, for example, of a polyester material, and has a radiused lower surface 62 substantially matching the surface 52 of the bar 50. The batting member and cleaner bar arrangement establishes a particular configuration providing opposed substantially parallel surfaces. With the batting 60 received in the bar receptacle 58, a cleaning material 64 (see FIG. 6), in the form of a mildly abrasive cloth for example, is wrapped about the bar and batting member.

The holding member 44 for the cleaning pad assembly 42 includes a yoke 66 having a pair of generally upstanding arms 68. The arms 68 respectively define slots 68*a* adapted to receive the tabs 56 of the legs 54 respectively of the cleaning pad assembly 42 to hold the assembly in a predetermined location relative to the corona wires 14 and grid 34, and particularly the primary operative surfaces thereof. While the arms 68 are substantially rigid, they have sufficient flex to enable them to be bent to the extent that the tabs 56 can be inserted into the slots 68*a* (or removed from the slots) to provide for mounting of the cleaning pad assembly 42, or replacement thereof when the cleaning material 64 is no longer effective.

The yoke 66 of the holding member 44 has a depending leg 70 which extends through a longitudinally oriented slot 72 defined in the corona charger housing shell 12. The remote end of the leg 70 is connected to a traveling nut 74 mounted on a lead screw 76. The lead screw 76 is supported in bearing blocks 78*a* and 78*b* attached to the housing shell 12 respectively adjacent to the portions 12*a* and 12*b* thereof. A bi-directional motor 80, mounted on the bearing block 78*b*, is coupled to the leadscrew 76 through a gear combination 82. When the motor 80 is activated in either direction, the lead screw 76 is correspondingly rotated in a one direction or in the opposite direction about its longitudinal axis. Due to the interaction of the leg 70 of the holding member 44 with the slot 72, the traveling nut 74 is restrained from rotation with the lead screw 76 by the attachment to the leg confined by slot 72. Accordingly, rotation of the lead screw will cause the traveling nut to move in a linear direction along the longitudinal axis of the lead screw. Of course, movement of the traveling nut 74 causes a corresponding linear movement of the holding member 44 and thus the cleaning pad assembly 42. Such movement of the cleaning pad assembly 42 brings the cleaning material 64 into operative cleaning relation with at least the operative surfaces of the corona wires 14 and the charge control grid 34 to effect efficient cleaning thereof. It should be understood that a motor rotating the lead screw in a single direction, with the lead screw being of the double helix type, is also suitable for use with this invention.

The automatic control of the cleaning mechanism 40 for the corona charger 10, as noted above, is effected by the logic and control unit 48. The logic and control unit 48 includes a circuit board 84 mounted on a bracket **84*a* attached to the bearing block 78*b*. The circuit board 84 has a microprocessor which receives input signals and timing signals. Based on such signals and a program for the microprocessor, the logic and control unit 48 produces signals to control the timing and operation of the motor 80**. The production of a program for a number of commercially available microprocessors, which are suitable for use with the invention, is a conventional skill well understood in the art. The particular details of any such program would, of course, depend on the architecture of the designated microprocessor. Of course, the microprocessor may be remotely located from the circuit board; such as for example it may be part of a main logic and control unit of the reproduction apparatus with which the corona charger is associated.

Certain input signals for the microprocessor of the unit 48 are provided by a home position switch 86 and a reversing switch 88. The switch 86 is a home position sensor located adjacent to the portion **12*a* of the corona charger housing shell 12. When the cleaning pad assembly 42 is in the home position (see FIG. 2), it is located so as to be out of contact with the corona wires 14**. This prevents any undue strain on the fragile corona wires. The cleaning pad assembly may be in contact with the grid, but care must be taken in setup such that the distance between the grid and the surface to be charged is not altered as this may affect the charge deposited on such surface.

At predetermined intervals, the logic and control unit 48 activates the motor 80 to rotate the lead screw 76 in one direction or in the opposite direction. As explained above, such rotation moves the cleaning pad assembly 42 linearly in a direction along the length of the corona wires 14 and charge control grid 34 to clean the respective parallel operative surfaces thereof. Upon initial movement of the holding member 44 and the cleaning pad assembly 42, from the home position, such mechanism must move over the wall **16*a*. As described above, the wall 16*a* is configured with a rounded upper surface and outboard corona wire locating notches. Such configuration provides an important function with this invention in that it has been found to significantly reduce the forces (e.g., the torque on the motor 80) required to move the holding member and cleaning pad assembly over the wall 16*a*. This simplifies the construction of the cleaning mechanism 40 (and thus the overall construction of the corona charger 10), and reduces the power requirements for the motor 80. When the cleaning pad assembly 42 is between the corona wires 14 and the charge control grid 34**, it is controllably compressed as it moves. This compression exerts the desired proper cleaning pressure on the wires and grid to improve the cleaning efficiency thereof.

When the cleaning pad assembly 42 has fully traversed the working area of the corona wires 14, to a remote position from the home position, the traveling nut 74 will contact the reversing switch 88. An appropriate signal will be sent to unit 48 to cause the motor 80 to reverse its direction of operation, and thus rotate the lead screw 76 in the opposite direction. Accordingly, the direction of travel for the traveling nut 74 will be reversed and the cleaning pad assembly will be moved in the opposite direction toward the home position. When the cleaning pad assembly reaches the home position, the switch 86 will send an appropriate signal to unit 48 to cause the motor 80 to stop. The cleaning pad assembly 42 will be maintained in the home position, out of the way of the operation of the corona charger 10, until the next desired cleaning interval. For example, a cleaning cycle may be initiated on start up of the reproduction apparatus, and also on apparatus cycle out after every 10,000 images, or may selectively be initiated at the discretion of the operator. Of course the number of images between cleaning cycles is programmable by the logic and control unit 48 to achieve the most efficient operation of the cleaning apparatus 40.

The invention has been described in detail with particular reference to preferred embodiment thereof, but it will be understood that variations and modifications can be effected within the spirit and scope of the invention as set forth in the claims.

What is claimed is:

1. A mechanism for automatically cleaning the primary operative surfaces of corona wires and charge control grid of a corona charger at the same time, said cleaning mechanism comprising:

a cleaning pad assembly including a cleaner bar having a main body defining an upper surface and a pair of legs depending from said main body adjacent to the ends thereof, said main body and the legs defining a receptacle for a batting member having a lower surface substantially matching said upper surface of said cleaner bar, and cleaning material wrapped about said cleaner bar and batting member, said upper surface and said lower surface providing opposed substantially parallel surfaces for wiping substantially parallel operative surfaces of said corona wire and charge control grid with said cleaning material;

means for holding said cleaning pad assembly within said corona charger in association with said corona wire and charge control grid;

means, associated with said holding means, for moving said holding means linearly along substantially the length of said corona wire and charge control grid; and means for automatically selectively activating said moving means to move said holding means such that said cleaning pad assembly is moved to clean said corona wire and charge control grid at the same time.

2. The corona charger corona wire and charge control grid cleaning mechanism of claim 1, wherein said means for moving said holding means includes a motor, a lead screw, means for connecting said motor to said lead screw for rotation of said lead screw by said motor, and means for transferring rotation of said lead screw into such linear movement of said holding means.

3. The corona charger corona wire and charge control grid cleaning mechanism of claim 2, wherein said means for transferring rotation of said lead screw into linear movement of said holding means includes a traveling nut mounted on said lead screw, said traveling nut being connected to said holding means and prevented from rotating with said lead screw, such that rotation of said lead screw in one direction moves said traveling nut, and thus said holding means, linearly from a home position at one end of said corona charger to a remote position adjacent to the other end, and rotation of said lead screw in the opposite direction returns said traveling nut, and thus said holding means, from said remote position to such home position.

4. The corona charger corona wire and charge control grid cleaning mechanism of claim 3, wherein said lead screw is of the double screw helix type such that rotation of said lead screw in one direction moves said holding means linearly from said home position to said remote position and then returns said holding means from said remote position to such home position.

5. The corona charger corona wire and charge control grid cleaning mechanism of claim 3, wherein said holding member includes a depending leg, passing through a slot defined by said corona charger, coupled to said traveling nut, the interaction of said leg and said slot serving to prevent rotation of said traveling nut.

6. The corona charger corona wire and charge control grid cleaning mechanism of claim 3, wherein said means for automatically selectively activating said moving means to move said holding means includes a logic and control unit for selectively activating said motor.

7. The corona charger corona wire and charge control grid cleaning mechanism of claim 6, wherein said logic and control unit includes programmable means for activating said motor at preselected intervals of operation of said corona charger.

8. The corona charger corona wire and charge control grid cleaning mechanism of claim 6, wherein said logic and control unit further includes limit switches located relative to said corona charger respectively adjacent to said home position and said remote position of said holding member, said switches respectively producing signals sent to said logic and control unit to set the limits of linear travel of said holding means.

9. The corona charger corona wire and charge control grid cleaning mechanism of claim 1, wherein said legs of said cleaner bar main body have tabs respectively extending therefrom adapted to be removably received by said holding member; and wherein said holding member includes a yoke having a pair of generally upstanding arms, said arms respectively defining slots adapted to receive said tabs of said legs respectively of said cleaning pad assembly cleaner bar to hold said cleaning pad assembly in a predetermined location relative to said corona wires and charge control grid.

10. The corona charger corona wire and charge control grid cleaning mechanism of claim 9, wherein said arms of said yoke are substantially rigid, yet have sufficient flex to enable them to be bent to the extent that said tabs of said cleaner bar legs can be inserted into the slots to provide for mounting of said cleaning pad assembly, or replacement thereof when said cleaning material is no longer effective.

11. In a corona charger having a housing substantially U-shaped in cross-section, means for anchoring at least one corona wire within said housing connected to a electrical potential source, means for supporting said corona wires to extend a substantial length of said housing, and a charge control grid extending for substantially the length of said housing across the extremities of the legs of the U-shaped housing, a mechanism for automatically cleaning the operative surfaces of the corona wires and charge control grid at the same time, said cleaning mechanism comprising:

a cleaner bar having a main body defining a radiused surface;

a batting member having a radiused surface substantially matching said radiused surface of said cleaner bar, said batting member located in juxtaposition with said cleaner bar to provide opposed substantially parallel surfaces;

cleaning material wrapped about said cleaner bar and batting member for wiping substantially parallel operative surfaces of the corona charger corona wire and charge control grid;

a holding member for holding said cleaner bar within said housing of said corona charger such that said cleaning material is located in association with said corona wire and charge control grid;

means, associated with said holding member, for moving said holding member linearly along the supported length of said corona wire and charge control grid, said moving means including a lead screw rotatable about its longitudinal axis, and means for transferring rotation of said lead screw into linear movement of said holding member; and means for automatically selectively rotating said lead screw to move said holding member such that said cleaning material cleans said opposed surfaces of said corona wire and charge control grid at the same time.

12. The corona charger corona wire and charge control grid cleaning mechanism of claim 11, wherein said cleaning bar includes a pair of legs depending from said main body adjacent to the ends thereof, said main body and the legs defining a receptacle for receiving said batting member, said legs having tabs respectively extending therefrom; and wherein holding member includes a yoke having a pair of generally upstanding arms, said arms respectively defining slots adapted to receive said tabs of said cleaner bar respectively.

13. The corona charger corona wire and charge control grid cleaning mechanism of claim 12, wherein said arms of said yoke are substantially rigid and have sufficient flex to enable them to be bent to the extent that said tabs of said cleaner bar legs can be inserted into the slots to provide for mounting of said cleaning pad assembly, or replacement thereof when said cleaning material is no longer effective.

14. The corona charger corona wire and charge control grid cleaning mechanism of claim 12, wherein said means for transferring rotation of said lead screw into linear movement of said holding means includes a traveling nut mounted on said lead screw and connected to said holding yoke of said holding member.

15. The corona charger corona wire and charge control grid cleaning mechanism of claim 14, wherein said yoke of said holding member includes a depending leg, passing through a slot defined by said corona charger housing, coupled to said traveling nut, the interaction of said leg and said slot serving to prevent rotation of said traveling nut.

16. The corona charger corona wire and charge control grid cleaning mechanism of claim 14, wherein said lead screw is a double screw helix such that rotation of said lead screw will move said holding means from one end of said corona charger to the other end and then return said holding means to said one end.

17. The corona charger corona wire and charge control grid cleaning mechanism of claim 11, wherein said means for automatically selectively activating said means to move said holding member includes a logic and control unit for selectively activating said motor.

18. The corona charger corona wire and charge control grid cleaning mechanism of claim 17, wherein said logic and control unit can be programmed to activate said motor at preselected intervals.

19. The corona charger corona wire and charge control grid cleaning mechanism of claim 18, wherein said logic and control unit further includes limit switches located relative to said corona charger, said switches respectively producing signals for said logic and control unit to set the limits of linear travel of said holding member.

20. The corona charger corona wire and charge control grid cleaning mechanism of claim 11, wherein said means for supporting said corona wires includes spaced generally upstanding walls respectively having a rounded top and notches in the outboard side adjacent to said top to locate said corona wires for the purpose of facilitating movement of said cleaning bar over said corona wire support means.

* * * * *